United States Patent [19]

Kehr et al.

[11] Patent Number: 4,768,176

[45] Date of Patent: Aug. 30, 1988

[54] APPARATUS FOR ALERTING A PATIENT TO TAKE MEDICATION

[76] Inventors: Bruce A. Kehr, 9429 Holbrook La., Potomac, Md. 20854; Albert L. Hedrich, 6804 Wemberly Way, McLean, Va. 22101

[21] Appl. No.: 628,420

[22] Filed: Jul. 6, 1984

[51] Int. Cl.[4] ..... G04B 47/00; B65D 83/04

[52] U.S. Cl. ..... 368/10; 368/109; 221/2; 221/15

[58] Field of Search ..... 368/10, 250–251; 340/309.15, 309.4; 221/2, 3, 15; 364/569

[56] References Cited

U.S. PATENT DOCUMENTS

| | | | |
|---|---|---|---|
| 4,120,148 | 10/1978 | Moyer | 368/70 |
| 4,223,801 | 9/1980 | Carlson | 368/10 |
| 4,239,845 | 10/1981 | Villa-Real | 340/309.3 |
| 4,258,354 | 3/1981 | Carmon et al. | 340/309.4 |
| 4,302,752 | 11/1981 | Weitzler | 340/309.15 |
| 4,361,408 | 1/1982 | Wirtschafter et al. | 368/10 |
| 4,382,688 | 5/1983 | Machamer | 368/10 |
| 4,419,016 | 12/1983 | Zoltan | 368/10 |
| 4,449,829 | 5/1984 | Ikemoto et al. | 368/63 |
| 4,473,884 | 9/1984 | Behl | 364/479 |
| 4,483,626 | 11/1984 | Noble | 368/10 |
| 4,488,820 | 12/1984 | Takebe | 368/273 |
| 4,490,711 | 12/1984 | Johnston | 340/309.4 |
| 4,504,153 | 3/1985 | Schollmeyer | 368/10 |
| 4,588,303 | 5/1986 | Wirtschafter et al. | 368/10 |

*Primary Examiner*—Vit W. Miska

*Attorney, Agent, or Firm*—Hall, Myers & Rose

[57] ABSTRACT

A container for medication has four compartments, each of which may store medication. An electrical signaling system emits take-medication signals from time to time, each of which said signals indicates (a) that medication should be taken, (b) from which compartment the medication should be taken, (c) the quantity of medication to be taken from the designated compartment, and instructions for taking the medication. If a designated compartment is not promptly opened and closed, the electrical signaling system will sound an alarm. If each designated compartment is opened and closed, the take-medication signal and the alarm (if operating) are turned off. A "night" switch is associated with each compartment and when manually operated turns off the signaling system for such compartment; however, the signaling system is automatically reactivated the next morning. A reload signal is given once a week, as a reminder to reload the compartments with medication.

10 Claims, 3 Drawing Sheets

APPARATUS FOR ALERTING A PATIENT TO TAKE MEDICATION

BACKGROUND OF THE INVENTION

It is a frequent occurrence that a patient does not properly take his or her medication as prescribed by his or her physician. This is especially true for elderly patients who must take several different medications at various times throughout the day. The problem has been especially serious when the patient has impaired eyesight and/or is confused. The problem manifests itself in various ways, such as (1) failure to take the medication, (2) taking the wrong medication (3) taking too much of, or too little of, the correct medication, and (4) taking the medication at an incorrect time.

Patents have issued in the past for portable medication devices which give a signal at the time medication is to be taken. Wirtschafter, U.S. Pat. No. 4,361,408 is one such patent. It also discloses a squelch circuit for turning off the signal at night. None of the patents, however, have any satisfactory arrangement for turning off the signal at night when it is not needed and automatically turning the singal back on early the next day.

SUMMARY OF THE INVENTION

The longstanding problem described above has been solved by our invention described below:

A container compartment is used to store medication.

An electrical signaling circuit, having a timing system therein, gives a signal whenever medication is to be taken.

When the medication in a compartment is not to be taken at night, the patient may depress a special night cut-off switch which latches-out the signaling system for the night; however, the signaling system automatically restarts at a preset time the next morning.

The timing circuit has a twenty-four hour signal which will restart the take-medication signal each morning if it is turned off at night as aforesaid.

DETAILED DESCRIPTION OF THE DRAWINGS

Figure 1:
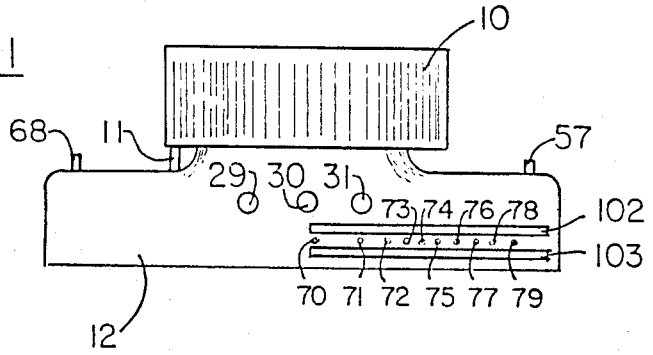
FIG. 1 is side view of a pill bottle embodying the invention.

FIG. 1 illustrates a pill container 12 having a screw-type lid or cap 10, and an electrical switch 11 which momentarily operates electrical circuitry (hereinafter described) when the cap 20 is screwed onto the container 22 to close it.

Figure 2:
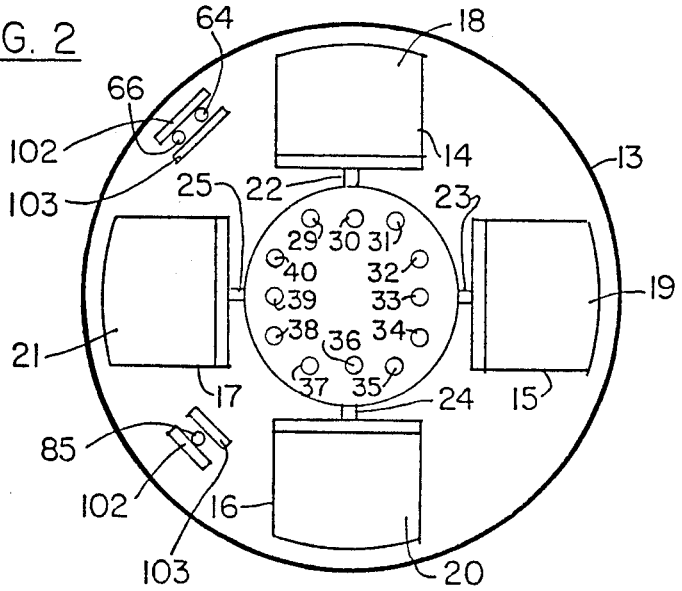
FIG. 2 is a top view of the preferred form of the invention.

FIG. 2 illustrates casing 13 having four different pill compartments 14, 15, 16 and 17, having lids 18, 19, 20 and 21 respectively. Each of the four lids 18, 19, 20 and 21 for the four compartments 14, 15, 16 and 17, is pivoted at its inner end to the pill compartment; for example lid 21 is attached to compartment 17 by a pivoted connection 26 which permits the lid 21 to be opened and closed by rotating it about the connection 26. Each of lids 18, 19, 20 and 21 has means for holding it closed; for example, the lid 21 has a projection terminating in a large ball 28 which snaps into contoured indent 27. The ball 28, and/or the walls defining indent 27, are sufficiently flexible so that the ball 28 snaps into and out of indent 27.

The lids 18, 19, 20 and 21 have associated electrical switches 22, 23, 24 and 25 respectively. Each of these four switches is arranged to be momentarily closed (or opened if the associated circuitry so requires) when its complementary lid 18, 19, 20 or 21 is closed.

Figure 4:
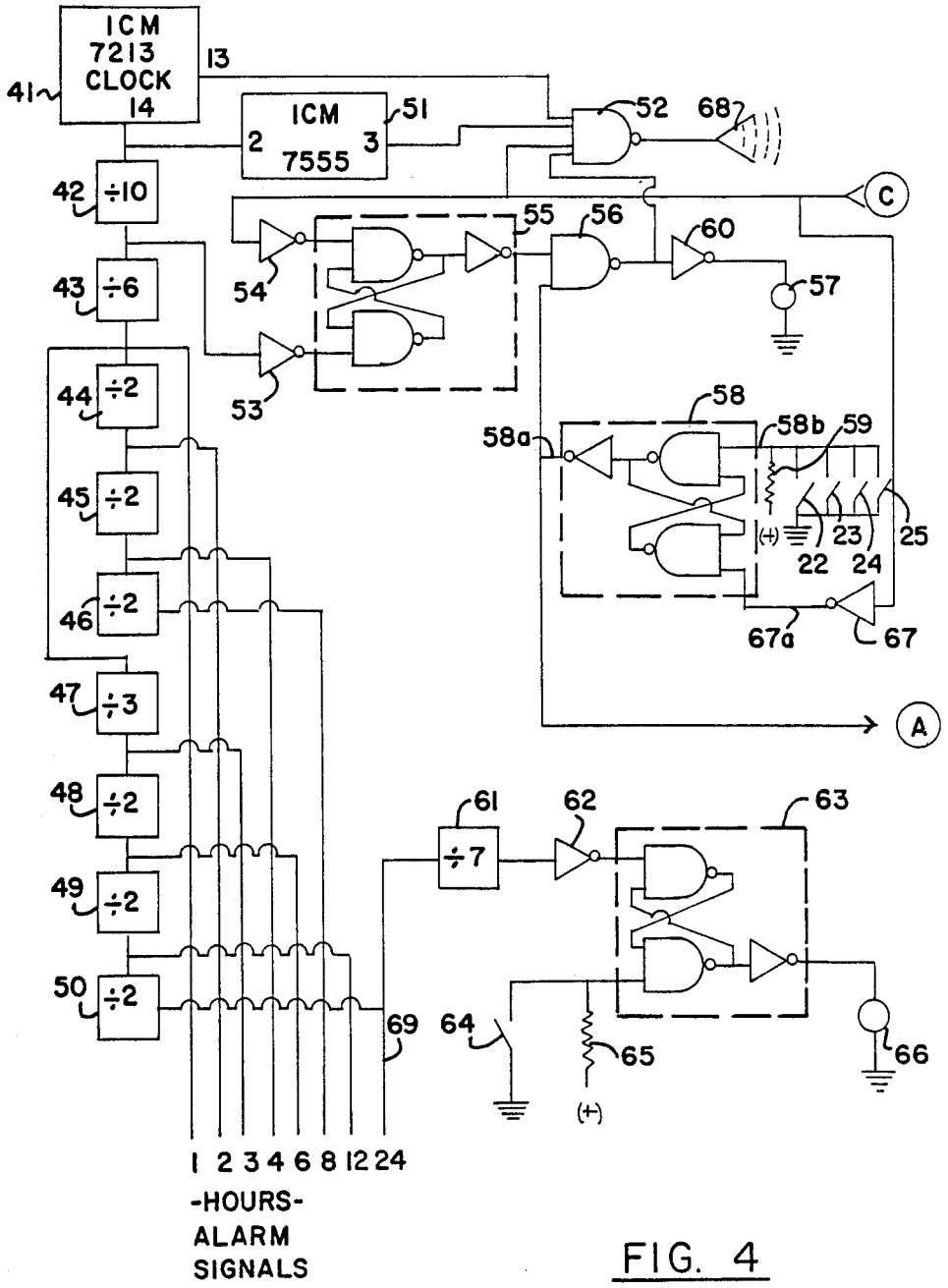
FIG. 4 is a schematic diagram of the electrical circuitry used in practicing the invention.
Figure 5:
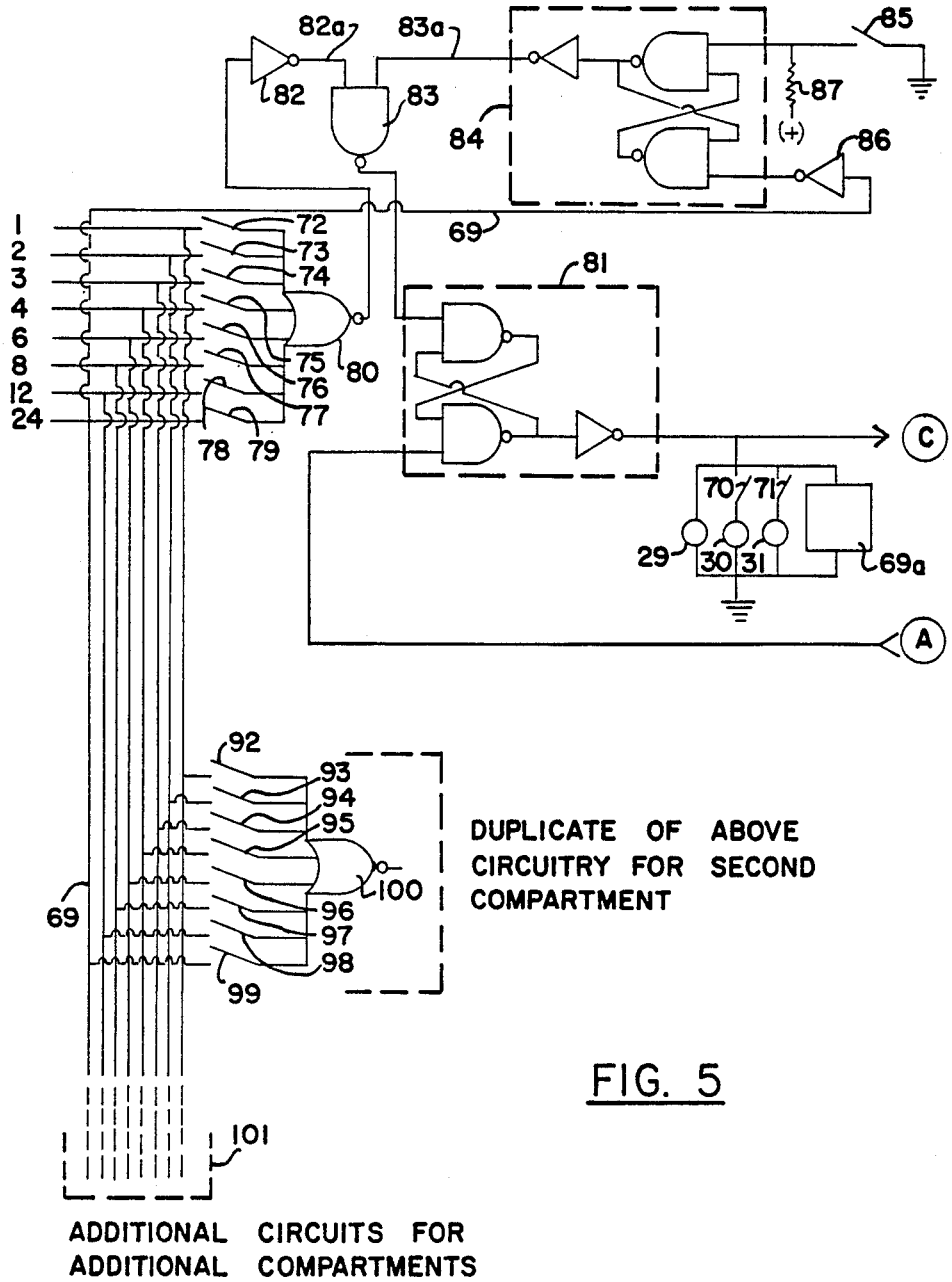
FIG. 5 is a schematic diagram showing additional circuitry used in practicing the invention and also showing the interconnection of that circuitry with the circuitry of FIG. 4.

Located within the casing 13, but not in any of the compartments 14 to 17, is the electrical circuitry shown in FIGS. 4 and 5. Basically, this circuitry can be set to give signals from time to time to alert the patient to take one or more pills. The circuitry will also designate the pill compartment 14 to 17 which contains the pill to be taken at any given time by illuminating one or more of the four light banks 29–31, 32–34, 35–37 and 38–40.

Assume, for purpose of illustration, that a patient is to take pills, everyday, as follows:

Pill A: 7 AM, 11 AM, 3 PM, 7 PM
Pill B: 7 AM, 1 PM, 7 PM
Pill C: 7 AM, 7 PM
Pill D: 7 AM only Pills, A, B, C, and D would be placed in compartments 14, 15, 16, and 17, respectively. The electrical circuitry, as we shall see, is settable to give signals at the various times, each day, at which pills are to be taken.

For Pill A, the patient will select circuitry that will repeat its signals every four hours starting at 7 AM. For Pill B, the patient will select circuitry that will repeat itself every six hours, again starting at 7 AM. For Pill C, the patient will select circuitry that will repeat itself every 12 hours starting at 7 AM and for Pill D, the patient will select circuitry that repeats itself once each day at 7 AM.

To satisfy the above illustration, at 7 AM the circuitry of FIGS. 4 and 5 will emit an audible signal for fifteen seconds and which audible signal will, repeat itself once a minute until it is stopped by the operation of switch 22 upon the closing of the lid 18 of compartment 14. At the same time that the audible signal begins, the electrical circuitry of FIGS. 4 and 5, will energize one or more of the three signal lights 29, 30 and 31 in the light bank 29–31. The light bank 29–31 is located closely adjacent to compartment 14, and thereby indicates to the patient that he or she is to take medication from compartment 14. The light bank 29–31 is deenergized by switch 22 when the lid 18 of compartment 14 is closed.

The light bank 29–31 has three signal lights 29, 30 and 31 (FIG. 5) which are pre-settable, as will appear, so that when the light bank 29–31 is energized only the correct number of these three lights will be energized. If one light is illuminated it means that the patient is to take only one pill from the compartment 14. When two of the signal lights are illuminated the patient is to take two pills from the compartment 14. When all three lights 29, 30 and 31, are illuminated, the patient is to take three pills.

Light bank 32–34 is closely adjacent compartment 15, light bank 35–37 is closely adjacent compartment 16, and light bank 38–40 is closely adjacent compartment 17. Thus, each light bank serves one compartment, and its function in conjunction with its complementary compartment is the same as the function of light bank 29–31 in conjunction with compartment 14.

Similarly, at 3 PM, and again at 7 PM a similar series of events occurs.

Since the timing circuitry repeats itself every 24 hours, each of compartments 14 to 17 may contain a number of pills; that is compartment 14 may contain a one-week supply of pill A, compartment 15 may contain a one-week supply of pill B, etc.

Wires A and C of FIG. 4 connect to wires A and C respectively, of FIG. 5. The block diagrams shown in FIGS. 4 and 5 show the logic and electronic circuitry to perform the following functions and operations:

The clock 41 with dividers 42 through 50 generate electrical signals at intervals of 1, 2, 3, 4, 6, 8, 12 and 24 hours (FIG. 4). The signal occurring at the desired interval is selected by closing the appropriate switch 72 through 79 (FIG. 5). When the selected signal occurs, the following events take place: Either one, two or three of the light emitting diodes (LEDs), 29, 30 and 31, are energized depending on whether one or both of the switches, 70 and 71, are closed. These switches are set at the time the pill-box is initialized to indicate the number of units of medication to be taken. At the same time a liquid crystal display (LCD) **69*a* (FIG. 5) is caused to display a preset message such a "MEALS", "MORN" or "EVE". As explained in more detail later, there is one LCD 69*a* for each compartment 14, 15, 16 and 17, and each such LCD 69*a* is closely adjacent its complementary compartment so the patient will associate the message on an LCD 69*a* with the compartment complementary to that LCD. At the same time the audible alarm 68 (FIG. 4) produces a unique sound for a period of 15 seconds at the beginning of every minute for a period of ten minutes. If, during the ten minute period following initiation of the alarm, the lid 18 of compartment 14 is opened and then closed the audible alarm, and the LED's and the LCD are shut off. If the alarm has not been answered by opening and closing the lid 18 within the ten minute period following initiation of the alarm, the audible alarm 68 is turned off. At the same time the red LED 57 is turned on. The red LED 57 will stay on as will the LEDs and LCD until the lid 18 of the compartment is opened and closed. Opening and closing the lid 18 of the compartment 14 operates the switch 22 (FIGS. 2 and 4**) in a manner explained later.

If the invention is designed to have an LCD **69*a* with an output inscribed with the word "MEAL", the pill in the container 14, 15, 16 or 17 closest to that LCD 69 would be taken at the meal next following the illumination of LCD 69*a*. An LCD display and driver, suitable for part 69*a***, is described in the Intersil publication on pages 6-84 through 6-103, a copy of which is being filed with this application. Either ICM7233 which provides 4 characters of 18 segments or ICM7234 which will drive 5 characters of 18 segments, would be suitable.

A signal from the divider 61 occurs seven days later causing the yellow LED 66 to be turned on indicating that it is time to re-load the box with medication. Alternatively, an LCD display of "LOAD" could be used rather than the yellow LED 66. The "LOAD" signal recurs every seven days, and thereby instructs the patient to re-load compartments 14 to 17 with pills. After each reloading the patient momentarily depresses switch 64 to turn off the load signal light 66.

The following is a detailed description of the operation of the electrical circuit shown in FIGS. 4 and 5. The symbols used in the figures follow accepted usage in showing logic devices. Where non-standard or special symbols are used, they are explained in the text.

FIG. 4 shows that part of the circuit that is common to all compartments and contains all parts of the circuit that perform functions not unique to any particular compartment 14 to 17. FIG. 5 shows those parts of the circuit unique to each compartment 14, 15, 16 and 17 and that, therefore, must be duplicated for each compartment 14, 15, 16 and 17.

All timing signals and the electrical signals for the audible signal originate in the clock 41. A commercially available unit suitable for this function is the Intersil ICM7213 One Second/One Minute Precision Clock and Reference Generator. This is described in detail on pages 7-42 through 7-46 of the Intersil reference book, HOT IDEAS IN CMOS. Photocopies of the referenced pages are being filed with this application. The signal present on pin 14 of this clock 41 is an electrical pulse occuring at a rate of one pulse per minute (1/60 Hz). These pulses are applied to a string of dividers 42 through 50 that act to divide the frequency at which the pulses occur. This is the equivalent to multiplying the time interval between pulses by the same factor. The divide-by-ten ($\div 10$) divider 42 is typically a Motorola MC14017B Decade Counter/Divider as shown on page 7-54ff of Motorola publication DL-105. The $\div 6$ divider 43 and $\div 3$ divider 47 are typically Motorola MC14018B Presettable Divide-by-N Counters described on page 78-59ff of the same Motorola publication. The $\div 2$ dividers 44, 45, 46, 48, 49 and 50 are typically Motorola MC14516B Binary Up/Down Counters described on page 7-406 of the same Motorola publication. Copies of the applicable pages of said Motorola publication are being filed with this application.

The $\div 10$ divider 42, and $\div 6$ divider 43, taken together divide the output of clock 41 by 60 and therefore produces a pulse once per hour at the output of divider 43. Dividers 44, 45 and 46 generate pulses at intervals of 2, 4 and 8 hours respectively. In a similar fashion, dividers 47 through 50 generate pulses at intervals of 3, 6, 12 and 24 hours.

The eight lines terminating at the bottom of FIG. 4 carry the signals for the eight periods described above. All eight lines go to all compartments, 14, 15, 16 and 17, of the casing 13. Refer now to FIGS. 2 and 5. The compartments 14, 15, 16 and 17 of the casing 13 have switches 22, 23, 24 and 25, respectively. Each compartment 14, 15, 16 and 17 has a set of parts identical to 70 to 87 incl., 29–31 incl., and 69. It should be understood that the description of the electrical circuitry for compartment 14 is valid for any of the compartments 15, 16 and 17 and that the four compartments 14 to 17 can be programmed independently of each other. All timing signals go to all compartments independently of what is happening with any of the others. Whether or not the alarm 68 is answered for one compartment has no bearing on whether the alarm 68 will sound for one of the other compartments.

To select the desired timing signals one of switches 72 to 79 is closed. For the illustration given above for Pill A, switch 75, which selectes a four hour period between the taking of pills, would be closed. At the chosen time the signal through switch 75 is connected to one of the inputs of the eight-input NOR gate 80. This is typically a Motorola MC14078B 8-Input NOR Gate described on page 7-5ff of the above-referenced publication. A copy of this publication is being filed with this application. All inputs and outputs of logic elements referred to in the remainder of this description can have only two states, 0 and 1, unless the contrary is explicitly stated. A NOR gate has the property that the output is 1 as long as all inputs are 0. If any input is 1, the output goes to 0. Therefore, the output of the NOR gate 80 is 1 until an alarm signal drives one of the eight inputs to 1 at which time the output goes to 0.

The latch 81 shown in dotted lines is typically a Motorola MC14044B Quad NAND R-S Latch described on page 7-120ff of the above-referenced Motorola publication. A copy of this publication is being filed with this application. The designation "Quad" indicates that there are four such latches shown in FIGS. 4 and 5 and typically they would be the four latches located on this IC. A NAND R-S latch has the property that a momentary transition from 1 to 0 on one of the inputs produces an output level that remains at this level until an appropriate level change at one of the inputs causes it to change to the other level, hence the name latch. The change can be momentary and the condition is latched-in until changed.

The top input to latch 81 may be driven from the output of NOR gate 80, via inverter 82 and NAND gate 83.

When the top input to latch 81 is driven (as just explained) to a 0 level by the output of the NOR gate 80, the output shown on the right side of the dotted rectangle is driven from 0 to 1. The output stays at this level until driven to 0 by the appropriate signal to the other input as will be described later. An output level of 1 usually represents a voltage level of about 4.5 to 5.0 volts. This is an appropriate voltage to turn on one or more of the green LED's 29, 30 and 31. LED 29 will always come on when alarmed and LED's 30 and 31 will come on when switches 70 and 71, respectively, are closed and the circuit to those switches is energized. The output signal is also sent to the circuits of FIG. 4 through line C. Wire A of FIG. 4 connects to wire A of FIG. 5, and wire C of FIG. 4 connects to wire C of FIG. 5.

The signal on line C is applied to three logic elements shown in FIG. 4: the NAND gate 52, the inverter 67 and the inverter 54. The function of each of these elements will be described below. The NAND gate 52 is typically a Motorola MC14012B Dual 4-Input NAND Gate described on page 7-5ff of the above-referenced Motorola publication. The designation "Dual" indicates that there are two identical gates on a single IC. A NAND gate has the property that the output is at a 1 level if any one of the inputs is a 0 level. When all inputs are at a 1 level, the output goes to a 0 level. NAND gate 52 is used to turn on the audible alarm 68.

As long as the level on the C line is at 0 the other three inputs to the NAND gate 52 will have no effect on the output. However, when the signal on the C line goes to 1, control goes to the other inputs of gate 52. Timer 51 controls one of the other inputs to NAND gate 52. Timer 51 typically is an Intersil ICM7555 and is described on page 6-155ff of the Intersil publication referred to above. In this application it is used as a monostable pulse generator as shown in FIG. 4, page 6-158 of the Intersil publication. The trigger applied to pin 2 of the timer 51 is obtained from the clock 41 output consisting of a pulse once per minute. The resistor and capacitor shown in FIG. 4 of the Intersil data book are chosen to produce a pulse of approximately 15 seconds width. The positive output pulse from pin 3 of the timer 51 is applied to one of the inputs of gate 52, hereinafter referred to as the center input. Thus, for the first 15 seconds of each minute the center input of gate 52 is at a 1 level. Thus, when the C line is at a 1 level, control of the output of gate 52 is transferred to the top input for the first 15 seconds of each minute.

The top input to gate 52 is obtained from pin 13 of the clock 41. This signal consists of a composite of a 1024 Hz, a 16 Hz and a 2 Hz signal. When converted into sound waves by the transducer 68, it produces a very distinctive alarm sound. When the other three inputs to gate 52 are at a 1 level, this signal from the clock 41 controls the output of gate 52 which is applied to the audible sound generator or transducer 68. Thus, the signal will sound for the first 15 seconds of each minute as long as the signal on the C line is at a 1 level.

Instead of applying the electrical alarm signal generated by the clock 41 to the audible signal generator 658, the electrical signal at the output of NAND gate 52 could be applied to the input of a hearing aid earphone so that the signal would be audible to a person with a hearing impairment. Alternatively, the output of NAND gate 52 may actuate a voice synthesizer, or the loud speaker of a radio or television set. A suitable voice synthesizer is shown and described on pages 28 to 42 of the March 1984 issue of BYTE magazine. A copy of this article is being filed with this application. The output of the voice synthesizer would feed the earphone of a hearing aid or a loudspeaker with instructions for taking the medication. Alternatively, the signal fed to audible signal generator 68 could start a recorder which would emit audible voice instructions to the patient as to how to take the medication.

The signal on the C line is also applied to the inputs of the two inverters 54 and 67. These inverters are typically Motorola MC14049UBV Hex Inverter/Buffers described on page 7-129ff of the above-referenced Motorola publication. An inverter has the property that it changes the input to its complement at the output. Thus, if the input is at a 1 level, the output is at a 0 level and vice-versa. The Hex designation indicates that there are six inverters on a single IC. Thus, all the inverters used in FIGS. 4 and 5 can be located on a single IC.

When the level on the C line goes to a 1 level as a result of the alarm signal, the top input to latch 55 is driven from a 1 level to a 0 level. The output of the latch 55 is driven to a 0 level which is applied to the top input of NAND gate 56 insuring that its output is at a 1 level. The inverter 60 output is at a 0 level and the red LED 57 is off. At the same time, the lower input **67*a* of latch 58 is driven to a 0 level by the signal on the C line applied to this input through the inverter 67. This drives the output of latch 58 to a 1 level which is applied to the bottom input of NAND gate 56. This transfers control of gate 56 to the top input. If the alarm is not answered by opening and closing the lid of the applicable compartment, during the ten minute period following the initiation of the alarm, a signal from the ÷10 divider 42 will drive the bottom input of latch 55 to a 0 level through inverter 53 which will cause the output of latch 55 to go to a 1 level. The output of NAND gate 56 will go to a 0 level and the red LED 57 will be turned on through inverter 60 and the sound emitted by transducer 68** will be turned off.

If, however, the alarm is answered by opening and closing the lid 18 of the compartment 14, the switch 22 is closed, momentarily, driving the top input **58*b* of latch 58 to a 0 level. The output 58*a* of latch 58 and the input of gate 56** will be driven to a 0 level and the red LED 57 will not be turned on. If the lid 18 of the compartment 14 is opened and closed after the 10 minutes following the alarm, the red LED 57 will be turned off.

The signal on the output 58*a* of latch 58 also appears on the A line. Reference to FIG. 5 shows that this signal on line A is applied to the bottom input of latch 81. The A line will go to a 0 level when the lid 18 of the compartment 14 is closed. This will drive the output of latch 81 to a 0 level and the green LED's 29, 30, and 31 will be turned off. At the same time the C line will go to a 0 level turning off the audible alarm 68. The entire system will be returned to a condition of readiness to accept the next alarm signal and the entire process will repeat as described above.

There is a circuit to allow the user of the pill-box to disable the alarm, on any of the compartments 14, 15, 16 and 17, and any such compartment so disabled will be automatically restored to its normal operating condition at the next occurrence of the 24-hour alarm signal at 7 AM. The reason for this is that it is probable that under some circumstances the patient would not want the alarm to sound during the night. However, in the event the patient failed to restore the system to its normal operating condition the next morning it is desired that this would be accomplished with components 82 through 87 (FIG. 5).

The night-shut off circuit operates in the following manner. Under normal conditions, i.e. the alarms set and not disabled, the right hand input 83*a* to NAND gate 83 is held positive by the output of the latch 84. It is assumed that a 24-hour signal on line 69 has occured since the circuits for all compartments 14, 15, 16 and 17 of the system are disabled. The disabling signal would have driven the bottom input to latch 84 from a 1 to a 0 state. Under this condition any signal applied to the input of NOR gate 80 through one of the switches 72 through 79 will cause the input of NAND gate 83 to go to a 1 state, driving the top input of latch 81 to 0. The sequence of events described above will then occur.

If and when it is desired to disable the circuit from a given compartment, for example compartment 14, "night" switch 85 is closed momentarily, causing the output 83*a* of latch 84 to go to 0. Under this condition the output of the NAND gate 83 will be 1 and will be unaffected by any input on its left had input 82*a*. This condition will persist until the occurence of the 24-hour alarm signal on line 69 (see FIG. 5). The 24 hour signal on line 69 (FIG. 55), resets latch 84 for normal daytime operation. Resistor 87 insures that the top input to latch 84 is at 1 until switch 85 is closed.

When the box is initially set it is only necessary to insure that the 24-hour signal occurs at the desired time in the morning; in this illustration at 7 AM.

Figure 3:
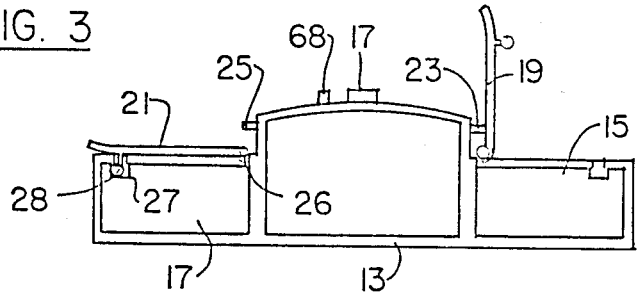
FIG. 3 is a side view of FIG. 2.

In the preferred form of FIGS. 2 and 3, the components 70 to 87 incl., 29, 30, 31 and 69*a* are used in conjunction with compartment 14. A "duplicate set" of all of these parts 70 to 87 incl., 29, 30, 31 and 69*a* is used for each of the other compartments 15, 16 and 17. This "duplicate set" for compartment 15 is partially shown in FIG. 5 by reference numbers 92 to 100 incl. Reference number 101 shows certain wires that feed the "duplicate set" for compartment 16, and the "duplicate set" for compartment 17.

OPERATION OF FIG. 1

The electrical circuitry used in conjunction with FIG. 1 is apparent from the foregoing. The form of invention shown in FIG. 1 may be used when the patient takes a single medication from time to time. If the medication is in the form of pills, they are placed in container 12, and a switch 11 is momentarily closed when lid 10 is screwed or otherwise inserted on the container 12. The circuitry of FIGS. 4 and 5 is used with FIG. 1 except that the duplicate circuitry 92 to 101 incl. of FIG. 5 is omitted.

The pill container 12 of FIG. 1 may be used by a patient who must take a given pill periodically. Assume that the pill is to be taken at four-hour intervals, the patient will close switch 74. As a result, the audible signaling device (transducer) 68 and one or more of signal lights 29, 30 and 31 will be energized every four hours, starting at 7 AM. After the 7 PM pill, the patient may momentarily depress switch 85 to deactivate the system until 7 AM.

If the patient obeys the commands of the system by, in response to each emission of an audible signal by transducer 68, promptly (a) opening the container (b) taking the number of pills indicated by signal lights 29, 30, 31, and (c) screwing lid 10 on the container (momentarily closing switch 11), the repeat audible warnings and the illumination of red LED 57 will not occur.

However, if the patient fails to open the container 12 and take a pill, the back-up warning system will be activated as follows: As explained above, there will be repeat audible warnings from transducer 68 for the first fifteen seconds of every minute, and after ten minutes the red light 57 (FIGS. 1 and 4) will be turned on.

Once a week, the re-load signal light 66 is illuminated, and after reloading container 12 with pills the switch 64 is momentarily closed to turn off signal light 66 until it comes back on one week later.

The device of FIG. 1, employs the circuitry 41 to 50 incl., 61 to 66 incl., and 69*a*, which energizes signal light 66 at 7 AM once a week thereby instructing the patient to reload container 12 with pills, as explained in conjunction with FIGS. 2 and 3. The patient sets one of switches 72 to 79 incl. to designate the time period between the taking of a given pill during the day. At each indicated time, pills from container 12 are to be taken as in the case of FIGS. 2 and 3. The audible signal 68, and one or more of signals lights 29, 30 and 31 (FIG. 5) are illuminated at the aforesaid various times during the day, as explained above as well as in conjunction with FIGS. 2 and 3.

In the form of FIG. 1, switch 11 of FIG. 1 corresponds to switch 22 of FIG. 4; switches 23, 24 and 25 being omitted in this modification. Since switch 11 (switch 22 in FIG. 4) closes momentarily when the lid or cap 10 is screwed onto container 12, the latch 58 will be reset, as explained in conjunction with FIGS. 2 and 3, and turns off (a) the audible signal 68 and (b) whichever one or ones of the signal lights 29, 30 and 31 which are on.

One, two or three of signal lights 29, 30 and 31 may be illuminated every pill-taking time, depending on the settings of manually operable switches 70 and 71. Similarly, at pill-taking time LCD 69*a* will be displayed. It too will be turned off when lid 10 is screwed onto container 12.

OPERATION OF FIGS. 2 AND 3

The 24 hour period of divider 50 is preferably once every 24 hours and may be set to run from 7 AM one day to 7 AM the next day.

To set the system to dispense Pill A in compartment 14 at four hour intervals starting at 7 AM, the patient depresses four-hour switch 75 associated with compartment 14.

Similarly, to set the system to dispense Pill B in compartment 15 every six hours the user would depress switch 96.

Likewise, to set the system to dispense Pill C in compartment 16 every 12 hours, the patient would depress that switch of the "duplicate set" assigned to compartment 16, corresponding to switches 78 and 98 of FIG. 4.

In similar fashion, to dispense Pill D from compartment 17, the patient would depress that switch of the "duplicate set" assigned to compartment 17, corresponding to switches 79 and 99 of FIG. 4.

The switches 70 and 71, and various switches of the "duplicate sets" would also be closed, as required to indicate the quantity of each pill which the patient should take each time the alarm sounds.

Let it be assumed that after taking the 7 PM pills, the patient wishes to turn off the device for the night, the "night" switches for all four compartments 14, 15, 16 and 17, corresponding to "night" switch 85 of FIG. 5, are momentarily closed. The system is now deactivated and no alarm will sound and no light banks will be illuminated until at least 7 AM when a signal appears on wire 69. The deactivation resulting from the momentary closure of switch 85 sets latch 84 to disable gate 83 and sets latch 81 to forbid the appearance of a signal on wire C. This precludes any current reaching light bank 29–31. It also precludes gate 52 from allowing current to pass to audible signaling device 68.

The patient may wish to take Pill B every six hours during the night but not take the other pills after 7 PM. In such case, "night" switch 85 associated with compartment 14 would be closed momentarily. This would deactivate the system, until 7 AM, insofar as it relates to compartment 14. (The systems relating to compartments 16 and 17 are not scheduled to produce signals between 7 PM and 7 AM). At 7 AM the system will be reactivated in view of the 24 hour signal on wire 69 energizing inverter 86. If one or both of compartments 16 and 17 were scheduled to produce alarms during the night they could be turned off by depressing their "night switches" 85. If the patient promptly takes the various pills as indicated by the system, the back-up warnings will not be given. However, if the patient does not open and close one or more of lids 18, 19, 20 and 21, as indicated by the system, the back-up audible and visible warnings will occur as described in conjunction with FIG. 1.

MISCELLANEOUS MATTERS APPLICABLE TO FIGS. 1 AND 2

There is the possibility that one or more of the switches described above may be inadvertently operated. To avoid this possibility the switches are of the push-button type and the push buttons are of small diameter, for example in the range of 0.05 to 0.15 inches in diameter; and protective ribs are positioned on both sides of a row of switches. Thus, in FIG. 1, the switches 70 to 79 incl., are of the push button type, are less than ⅛ inch in diameter, and are located in a row. The ribs 102 and 103 extend outwardly from the casing 12 a greater distance than the switches 70 to 79. Moreover, the ribs 102 and 103 are closely adjacent to the row of switches 70–79. Thus, the only practical way to operate the switches is by use of a rod of small cross-section that will readily fit between the ribs 102 and 103. The switches will, therefore, not be operated by normal handling of the casing 12. All of the switches of FIGS. 2 to 5 are also located in rows protected by ribs 102 and 103.

The medication need not be in the form of pills, for example, a small bottle of eye drops may be placed in one of the compartments.

The latches referred to above are a species of bistable devices.

Both the apparatus of FIG. 1, and that of FIG. 2, is portable and may be carried in a pocketbook. The electrical apparatus (FIGS. 4 and 5) may be supplied with power from a small battery (not shown). A conventional device for emitting signals when the battery needs replacing may be employed if desired.

The various switches shown in FIGS. 4 and 5 are mounted on the casing 13 of FIG. 2. Preferably, the switches relating to any given one of compartments 14 to 17 incl. are grouped adjacent to that compartment.

I claim to have invented:

1. In a device for providing medication,
a container for storing medication,
electrical means associated with said container for indicating when medication should be taken, comprising:
(a) timing circuit means for producing equally spaced first signals that recur periodically, and for producing a plurality of take-medication signals during the period between two of said first signals,
(b) means for suspending further take-medication signals,
(c) said timing circuit means including means for resuming the take-medication signals, but no earlier than the occurrence of the next one of said first signals to follow the said suspension of said take-medication signals,
(d) said timing circuit means producing said first signals independently of the means for suspending further take-medication signals.

2. In a device for providing medication as defined in claim 1, said equally spaced first signals recurring every twenty-four hours, said third named means being manually operable.

3. In a device for providing medication as defined in claim 1, in which one of said take-medication signals occurs once every twenty-four hours concurrently with one of said equally spaced first signals and the take-medication signals occurring periodically, unless suspended, during each twenty-four hour period.

4. In a device as defined in claim 1: said take-medication signal comprising both an audible signal and the visual display of at least one word.

5. In a device for providing medication,
a container for storing medication,
electrical means, associated with said container, having signal producing means for producing audible take-medication signals and thereby indicating when medication should be taken,
(a) timing circuit means for producing equally spaced first signals that recur periodically every twenty four hours, and for controlling said sound producing means to produce a plurality of spaced take-medication signals during the period between two of said first signals,
(b) manually operable means for suspending further take-medication signals with such suspension starting at a selected time after one of said first signals but substantially prior to the next of said first signals, (c) said timing circuit means including means for controlling said sound producing means to resume the take-medication signals, but no earlier than the occurrence of said next one of said first signals.

6. In a device for providing medication as defined in claim 5 in which said signal producing means includes means for producing at least some of the take-medication signals in the form of both audible and visual signals that coexist for at least a limited period of time.

7. In a device for providing medication as defined in claim 5, a casing, said container and said electrical means being located in said casing, said casing including a cover portion operable so that said container may be exposed for placing medication into the container and for removing medication from the container.

8. In a device for providing medication as defined in claim 5 said manually operable means comprising means for suspending the take-medication signals starting at any selected time between any two of said first signals that are spaced 24 hours apart.

9. In a device for providing medication, a container for storing medication, electrical means associated with said container including an electrically operated signaling device for indicating when medication should be taken, said signaling device having an input and giving a take-medication signal when its input is energized, said electrical means comprising:

(a) timing circuit means for producing equally spaced first signals that recur periodically, and for producing input signals to said signaling device to provide a plurality of take-medication signals during the period between two of said first signals, (b) means for suspending further take-medication signals comprising circuit means including: (1) a manually operated switch for starting the suspension, and (2) means responsive to the one of said first signals that next follows the operation of said switch for terminating said suspension, (c) said timing circuit means including means for resuming the take-medication signals, but no earlier than the occurrence of the next one of said first signals to follow said suspension of said take-medication signals, (d) said timing circuit means producing said first signals independently of the means for suspending further take-medication signals.

10. In a device for providing medication as defined in claim 9, said equally spaced first signals recurring every twenty-four hours.

* * * * *

UNITED STATES PATENT AND TRADEMARK OFFICE

CERTIFICATE OF CORRECTION

PATENT NO. : 4,768,176

DATED : August 30, 1988

INVENTOR(S) : Bruce A. KEHR, Albert L. HEDRICH

It is certified that error appears in the above-identified patent and that said Letters Patent is hereby corrected as shown below:

Column 1, line 24, correct the spelling of "signal";
line 60, change "20" to --10--;
line 61, change "22" to --12--;
Column 3, line 3, after "similarly," insert: --at 11 AM,--;
Column 4, line 36, the number "60" should not be in bold face type;
line 49, the numbers "29-31" should be in bold face type;
Column 6, line 17, change "658" to --68--;
Column 7, line 45, correct the spelling of "hand";
Column 8, line 17, cancel "by";
line 19, after "68," insert --by--.

Signed and Sealed this

Fourteenth Day of March, 1989

*Attest:*

DONALD J. QUIGG

*Attesting Officer*

*Commissioner of Patents and Trademarks*